US009421983B2

(12) United States Patent
Kim et al.

(10) Patent No.: US 9,421,983 B2
(45) Date of Patent: Aug. 23, 2016

(54) ACTIVE PRESSURIZATION SYSTEM MAKING USE OF PLATFORM TRACK AREA UPPER SLAB OF UNDERGROUND TRAIN STATION

(75) Inventors: Dong Hyeon Kim, Seoul (KR); Ho Seok Lee, Seoul (KR)

(73) Assignees: KOREA RAILROAD RESEARCH INSTITUTE, Gyeonggi-do (KR); BNTTEK INC Co., Ltd., Seoul (KR)

( * ) Notice: Subject to any disclaimer, the term of this patent is extended or adjusted under 35 U.S.C. 154(b) by 117 days.

(21) Appl. No.: 14/366,817

(22) PCT Filed: Jun. 1, 2012

(86) PCT No.: PCT/KR2012/004333

§ 371 (c)(1),
(2), (4) Date: Jun. 19, 2014

(87) PCT Pub. No.: WO2013/094829

PCT Pub. Date: Jun. 27, 2013

(65) Prior Publication Data

US 2014/0326159 A1 Nov. 6, 2014

(30) Foreign Application Priority Data

Dec. 20, 2011 (KR) ..... 10-2011-0138704

(51) Int. Cl.
*B61B 1/02* (2006.01)
*E21F 1/00* (2006.01)

(52) U.S. Cl.
CPC .... *B61B 1/02* (2013.01); *E21F 1/00* (2013.01)

(58) Field of Classification Search
CPC ..... E21F 1/00; E21F 1/003; E21F 13/00
USPC ..... 104/27–30; 454/166, 167, 188, 228, 454/254, 339
See application file for complete search history.

(56) References Cited

FOREIGN PATENT DOCUMENTS

| | | | |
|---|---|---|---|
| JP | 05-195699 | 8/1993 | |
| JP | 10-205299 | 8/1998 | |
| JP | 2003-222000 | 8/2003 | |
| WO | WO 2009-000531 | 12/2008 | |
| WO | WO 2009/000531 | * 12/2008 | ..... E21F 1/104 |

OTHER PUBLICATIONS

International Search Report mailed Oct. 4, 2012 for PCT/KR2012/004333.

* cited by examiner

*Primary Examiner* — R.J. McCarry, Jr.

(57) ABSTRACT

The present invention relates to an active pressurization system making use of a platform track area upper slab of an underground train station. A track area, where a fast train and a slow train pass through an underground train station, is divided into a fast-train running space and a slow-train running space by means of a partition wall. Formed in an upper slab of the train station, there are a first and a second air-stream out- and in-flow space respectively linking to the fast-train running space and the slow-train running space. The front end of the second air-stream out- and in-flow space is provided with a first port and a first damper, while the rear end is provided with a second port and a second damper. The second air-stream out- and in-flow space is provided with a third port for venting of the slow-train running space. The first air-stream out- and in-flow space is provided with a fourth port for venting of the fast-train running space. When a fast train is running, a control panel that receives a sensing signal input from a pressure sensor for sensing pressure ensures that, on the slow-train running space where there is no slow train waiting, the first and second ports are closed and the first and second dampers are open and the third port is open and on the fast-train running space the fourth port is open, while on the slow-train running space where there is a slow train waiting, the first and second ports are open and the first and second dampers are closed and an air supplying and venting fan is driven in such a way as to supply air to the slow-train running space where there is a slow train waiting. The present invention makes it possible to solve the problem of ringing in the ears of waiting passengers by providing the fast-train running space where fast trains pass through and the slow-train running space where slow trains either stop or pass through, and by actively adjusting the supply and venting of air.

14 Claims, 7 Drawing Sheets

-With APS, the maximum pressure deviation is reduced by 33.72% and ΔP/3s is reduced by 38.83%.

ACTIVE PRESSURIZATION SYSTEM MAKING USE OF PLATFORM TRACK AREA UPPER SLAB OF UNDERGROUND TRAIN STATION

This application claims the priority of Korean Patent Application No. 10-2011-0138704, filed on Dec. 20, 2011 in the KIPO (Korean Intellectual Property Office), the disclosure of which is incorporated herein entirely by reference. Further, this application is the National Stage application of International Application No. PCT/KR2012/004333, filed Jun. 1, 2012, which designates the United States and was published in Korean. Each of these applications is hereby incorporated by reference in their entirety into the present application.

TECHNICAL FIELD

The present invention relate to an active pressurization system utilizing an upper slab of a platform track in an underground train station, and more particularly to an active pressurization system utilizing an upper slab of a platform track area in an underground train station, which can reduce an air pressure generated by a fast train passing through the underground train station when a slow train waits while the fast train passes through the train station, to solve a problem of ear-discomfort of a waiting passenger, and can allow passengers to be safely evacuated by facilitating ventilation of smoke generated in the train station in an event of a train fire.

BACKGROUND ART

Among underground train stations having recently been constructed or opened for traffic in Korea, fast trains going direct to only primary transfer stations (e.g., Seoul Metro Line 9 or Incheon International Airport Train of Korea) are under operation, and for traffic operation of fast trains, a construction of 4-line-2-platforms type underground train stations has been planned.

However, even if the passing speed of the fast train currently in operation in underground train station is lower than or equal to 100 km/h, air pressure problems occurring in the platform are being reported. In future, an air pressure problem of a passenger waiting space may be raised in the underground train station where high-speed trains are running.

Meanwhile, in Hong Kong, $\Delta P$ of 700 Pa has been stipulated as the standard for ear-discomfort of a waiting passenger. In the underground train station where fast trains pass through, the problem of ear-discomfort of a waiting passenger may be solved by means of the structural methods such as increase of the number of vertical pits and ventilation pits or an adjustment of a tunnel pit mouth, which may, however, considerably increase the construction cost of underground train station.

DISCLOSURE OF THE INVENTION

Technical Problem

Aspects of the present invention provide an active pressurization system utilizing an upper slab of a platform track area of an underground train station, which can solve a problem of ear-discomfort of a waiting passenger by reducing an air pressure generated when a fast train passes through the underground train station, where a slow train can wait while the fast train passes through the train station, and can improve the safety of evacuated passengers by facilitating ventilation of smoke generated in the train station in an event of a train fire in the underground train station.

Technical Solution

To solve the above noted problems, the present invention is provided as follows.

In accordance with one aspect of the present invention, there is provided an active pressurization system utilizing an upper slab of a platform track area of an underground train station, wherein a track area, where a fast train and a slow train pass through in the station of an underground train station, is divided into a fast-train running space and a slow-train running space by means of a partition wall, a first and a second air-stream out- and in-flow space respectively linking through to the fast-train running space and the slow-train running space are formed in an upper slab of the train station.

Here, the front end of the second air-stream out- and in-flow space may be provided with a first port and a first damper, while the rear end is provided with a second port and a second damper, the second air-stream out- and in-flow space may be provided with a third port for venting of the slow-train running space, and the first air-stream out- and in-flow space may be provided with a fourth port for venting of the fast-train running space.

In addition, when a fast train is running, a control panel that receives sensing signals input from pressure sensors for sensing pressure ensures that, on the slow-train running space where there is no slow train waiting, the first and second ports are closed and the first and second dampers are open and the third port is open and on the fast-train running space the fourth port is open, while on the slow-train running space where there is a slow train waiting, the first and second ports are open and the first and second dampers are closed and an air supplying and venting fan is driven in such a way as to supply air to the slow-train running space where there is a slow train waiting.

Here, the first and second air-stream out- and in-flow spaces may be provided only on the underground train station where fast train and slow train run.

In addition, the air supplying and venting fan may be a ventilating fan installed in an adjacent ventilating plant of the underground train station.

The pressure sensors may be equidistantly installed from a location more than 3 km apart from the main-line section connected to the underground train station.

Here, if there is an adjacent underground train station, a pressure sensor may be installed in the main line section which enters or exits from the underground train station.

A fire detecting device for sensing a fire may be provided in the underground train station, and if a sensing signal is input from the fire detecting device, the control panel may control the third or fourth port to be opened to vent smoke in the fast-train running space and the slow-train running space.

In particular, the fire detecting device may be one of a heat sensor, a gas sensor and a thermal image camera.

Advantageous Effects

As described above, according to the present invention, the problem of ear-discomfort of waiting passengers by providing the fast-train running space where fast trains pass through and the slow-train running space where slow trains either stop or pass through, and by actively adjusting the supply and venting of air. In addition, the safety of evacuated passengers can be improved by facilitating ventilation of smoke generated in the station in an event of a train fire in the underground train station.

MODE FOR CARRYING OUT THE INVENTION

Figure 1:
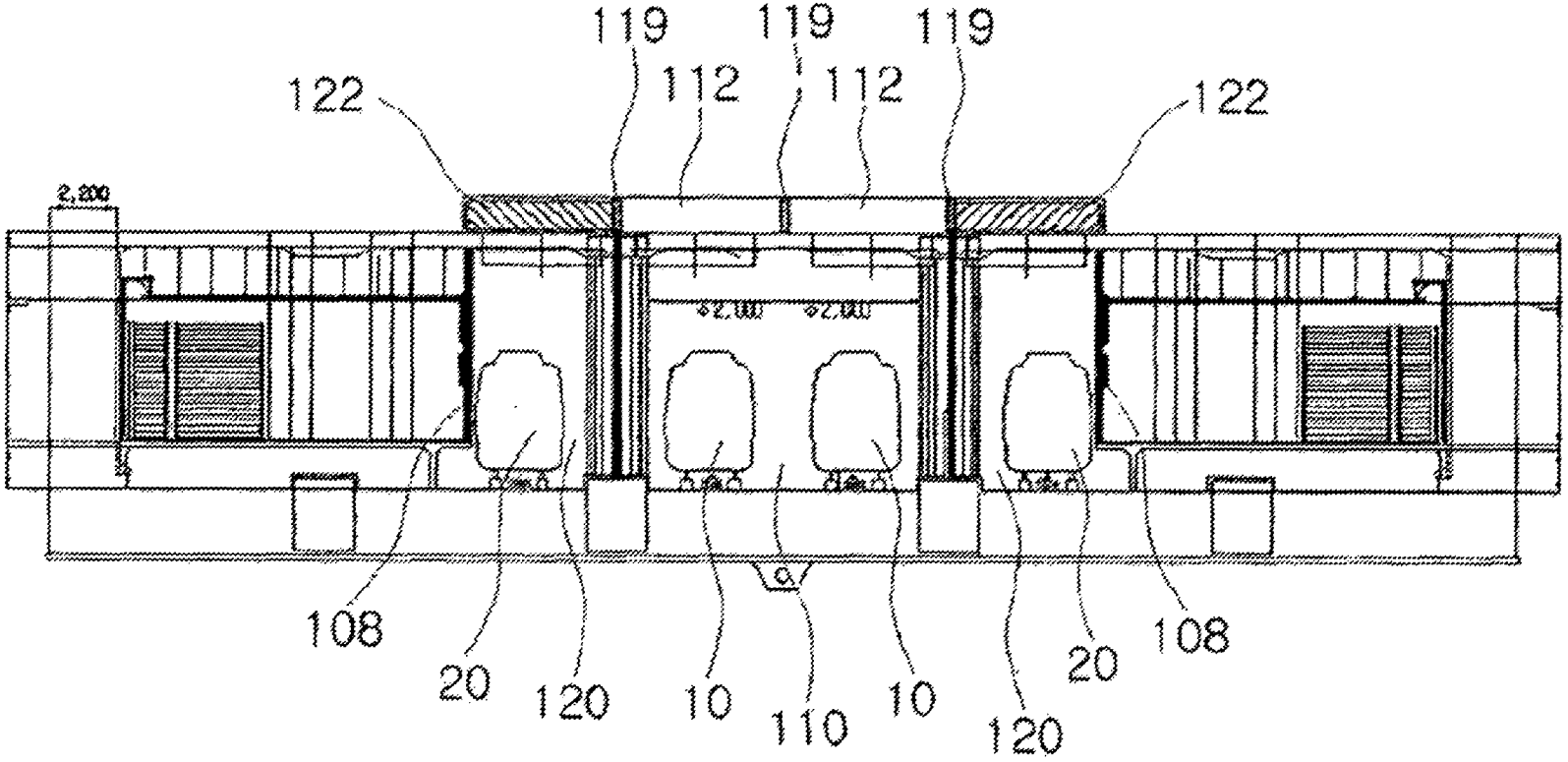
FIG. 1 is a cross-sectional view of a platform of an underground train station for an active pressurization system utilizing an upper slab of a platform track area of the underground train station according to the present invention.
Figure 2:
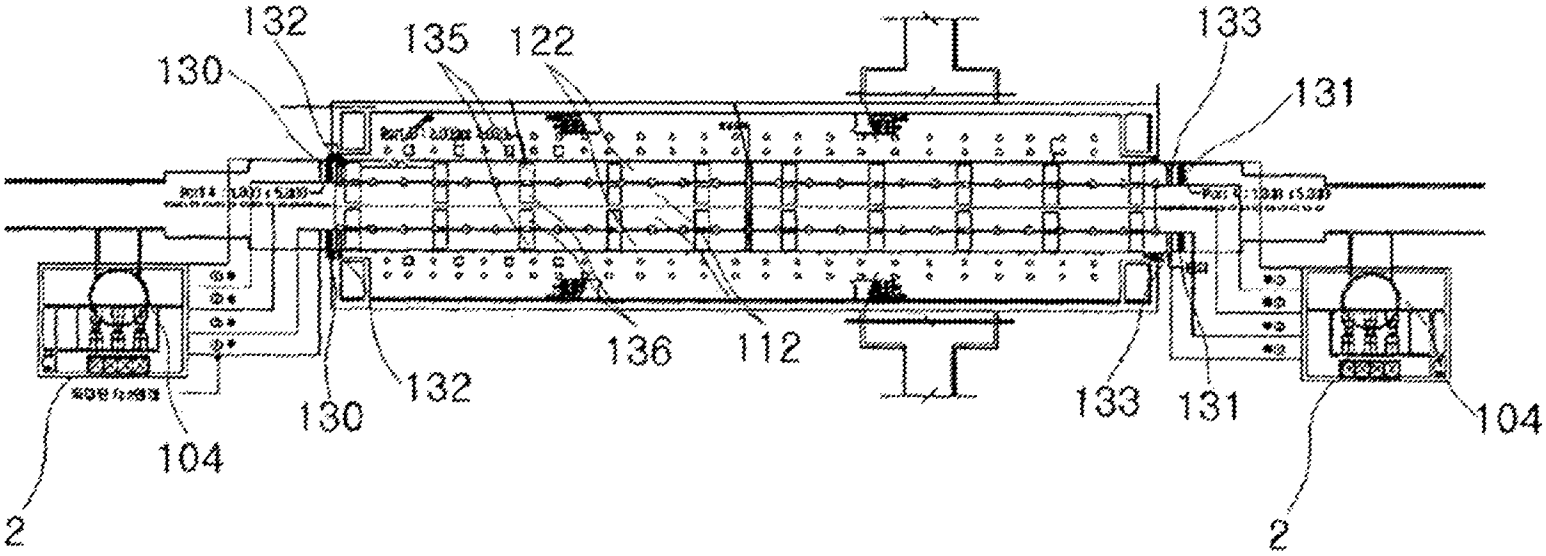
FIG. 2 is a plan view illustrating an upper portion of the platform of an underground train station for illustrating the active pressurization system active pressurization system utilizing an upper slab of a platform track area of the underground train station according to the present invention.
Figure 3:
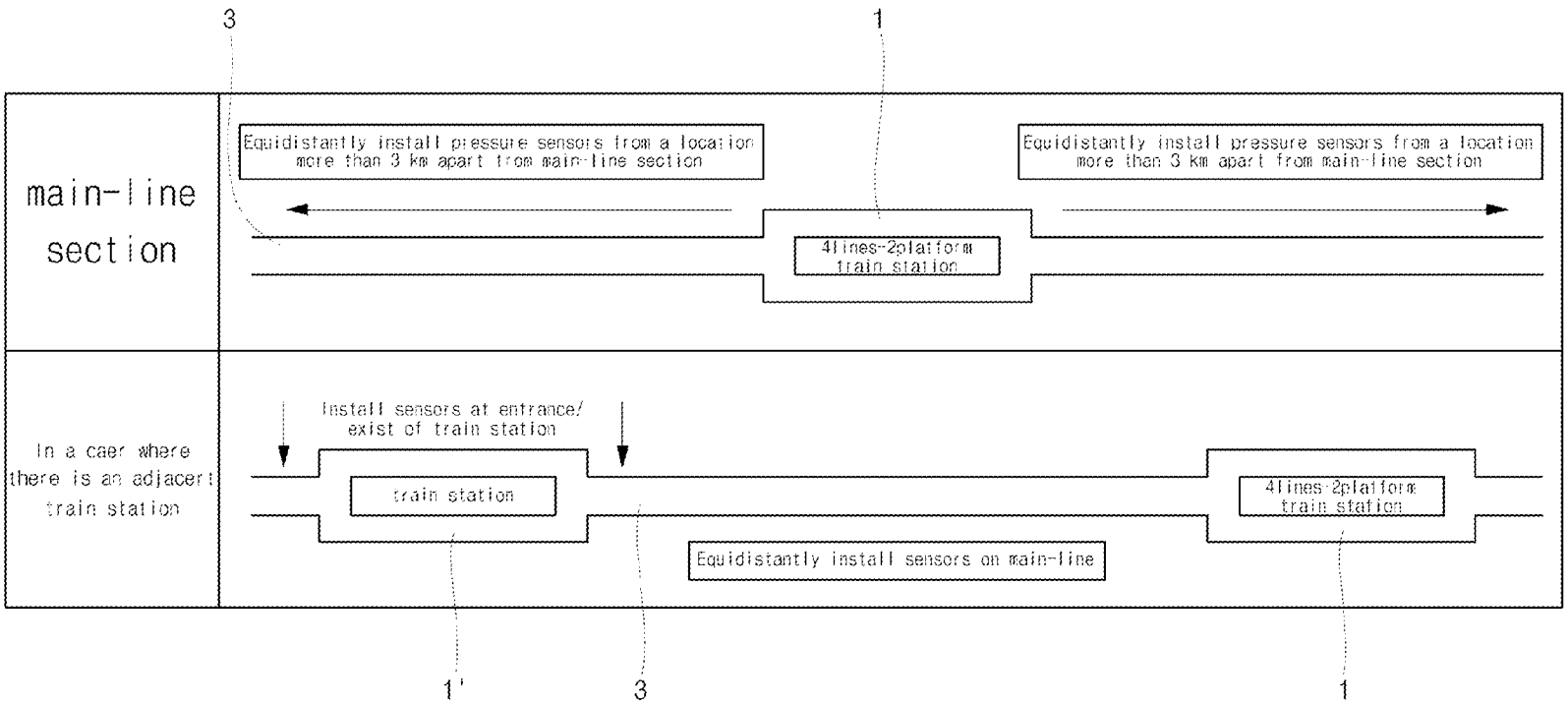
FIG. 3 is a view illustrating an installation position of a pressure sensor for the active pressurization system utilizing an upper slab of a platform track area of an underground train station according to the present invention.
Figure 4:
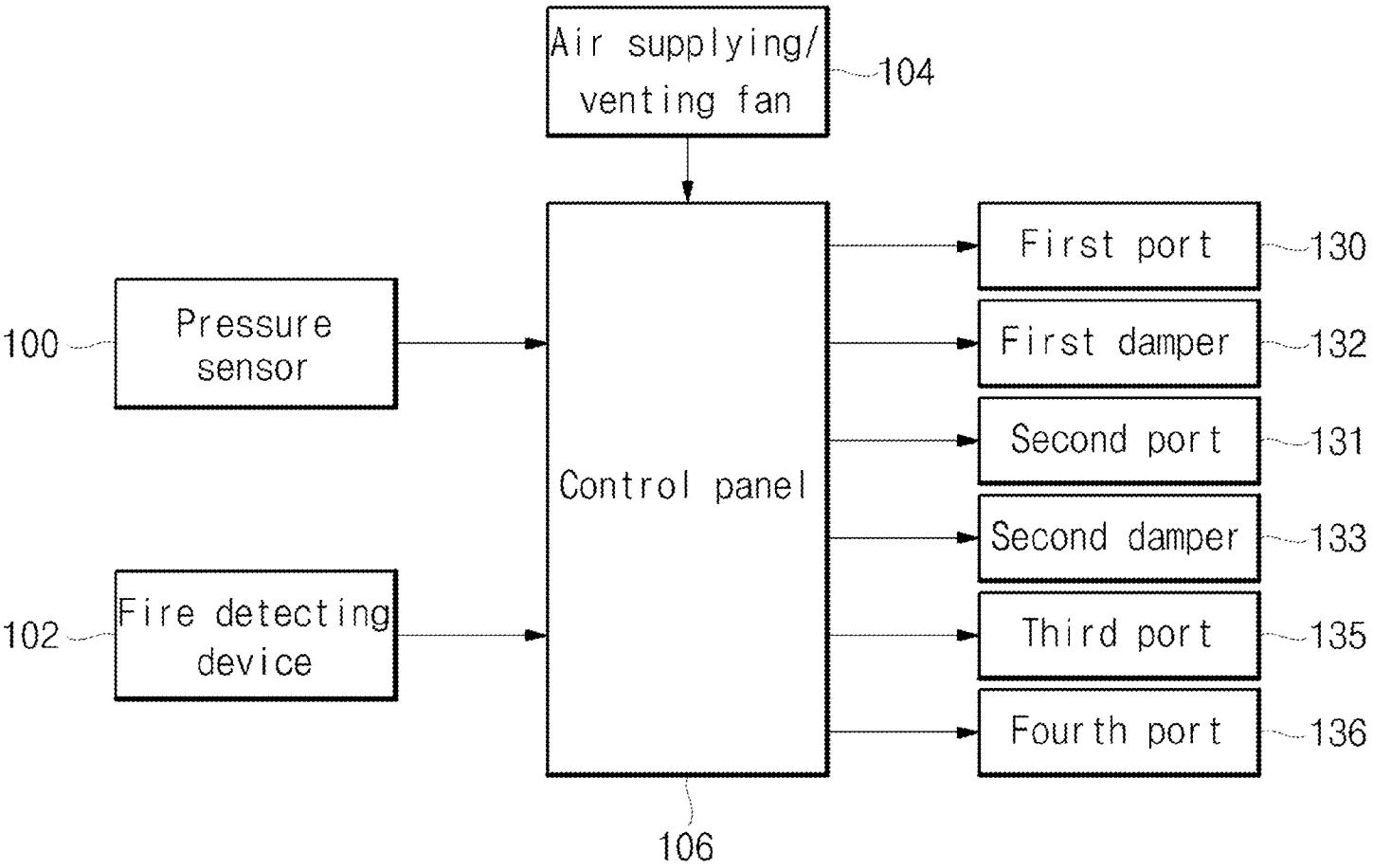
FIG. 4 is a schematic diagram illustrating a control operation of the active pressurization system utilizing an upper slab of a platform track area of an underground train station according to the present invention.

Hereinafter, advantages and features of the active pressurization system utilizing an upper slab of a platform track area of an underground train station according to the present invention will be understood through specific embodiments of the present disclosure described in detail with reference to the accompanying drawings.

Referring to FIGS. 1 to 4, the active pressurization system (APS) utilizing an upper slab of a platform track area of an underground train station 1 according to the present invention may form a space (pressurization zone) capable of supplying or venting air to actively process the pressure for each track using the upper slab of the platform track area, and may actively control the pressure through the supplying or venting of the air.

Here, the pressure waves generated in the train station can be reduced or blocked by supplying or venting the air through ports installed on the upper slab of the train station using a venting fan installed in an adjacent ventilating plant 2 or by installing a fan for active pressurization.

In particular, if a propagation of the pressure wave is sensed by a pressure sensor 100 installed in a neighboring main-line section 3, it is possible to reduce the magnitude of the pressure wave propagated from the main-line section 3 by venting the air through the port provided at an upper portion of a fast-train running space 110 of the underground train station 1, through which a fast train 10 passes, and the propagated pressure wave is reduced or blocked by supplying the air to a slow-train running space 120 through which a slow train 20 passes, thereby preventing a problem of ear-discomfort from being caused to a passenger waiting in the underground train station 1.

In addition, a fire-detecting device 102 is installed at an upper portion of the underground train station 1 and a location where a fire has broken out is sensed by the fire-detecting device to then open an upper port corresponding to the sensed fire location for evacuating smoke, thereby preventing the smoke from being propagated.

To this end, in the present invention, in a 4-line-2-platform type underground train station where fast trains and slow trains separately run, a space-dividing partition wall 119 can be installed in the track area to divide the fast-train running space 110 through which the fast train 10 passes and a slow-train running space 120 through which the slow train 20 passes, each of which acting as the pressurization zone. The fast train is an express train running with high speed and does not stop at every station for speedy operation. The slow train is an accommodation train running with low speed compared to the speed of the express train and stops at every station.

The space in the train station is divided into the fast-train running space 110 and the slow-train running space 120 by the space-dividing partition wall 119 to form the pressurization zones of the track area based on the upper active pressurization system (APS).

For the pressurization, a first and second air-stream out- and in-flow spaces 112 and 122, which are connected to the fast-train running space 110 and the slow-train running space 120, respectively, are formed at an upper slab of the train station on the track area to supply or vent the air to/from the fast-train running space 110 and the slow-train running space 120.

The first and second air-stream out- and in-flow spaces 112 and 122 for supplying or venting the air to/from the fast-train running space 110 and the slow-train running space 120 are defined at only an upper portion of the train station in which the fast train 10 and the slow train 20 run, and spatial dimensions of the flow spaces may be determined according to the characteristics of the train station. Preferably, the first and second air-stream out- and in-flow spaces are preferably have the heights of 1 m or greater.

Meanwhile, an air supplying and venting fan 104 is provided to supply or vent the air to/from the first and second air-stream out- and in-flow spaces 112 and 122. A ventilating fan installed in a ventilating plant 2 adjacent to the underground train station 1 may be used as the air supplying and venting fan 104 or separate fans may be installed to reduce a pressure applied to the train station. The number of fans is preferably determined according to the characteristics of tracks in the train station (for example, the numbers and arrangements of fast trains and slow trains).

At this time, the first and second air-stream out- and in-flow spaces 112 and 122 provided on the upper slab of the underground train station 1 are connected to the adjacent ventilating plant 2, and the connection method thereof may be varied according to the planning characteristics of the pressurization zones in the underground train station 1.

Meanwhile, the pressure sensor 100 capable of sensing the pressure waves generated when a train passes through a tunnel is installed for the active pressurization system (APS). Here, the location to which the pressure sensor 100 is installed may be selected according to the train running speed and the presence or absence of an adjacent underground train station and may be equidistantly installed from a location more than 3 km apart from the main-line section. In addition, when there is an adjacent underground train station 1', the sensor may also be installed in the underground train station 1'. The pressure sensor is installed in the main-line section which enters or exits from the underground train station 1'.

Meanwhile, the fire-detecting device 102 is installed in the underground train station 1 to sense occurrence of a fire. Here, even though a thermal sensor or a gas sensor may be utilized as the fire-detecting device 102, a thermal image camera is preferably employed as the fire detecting device to grasp a location in which a fire is occurred.

In addition, the front end of the second air-stream out- and in-flow space 122 is provided with a first port 130 and a first damper 132 for the pressurization in the train station, and the rear end is provided with a second port 131 and a second damper 133, the second air-stream out- and in-flow space 122 is provided with a third port 135 for venting of the slow-train running space 120, and the first air-stream out- and in-flow space 112 is provided with a fourth port 136 for venting of the fast-train running space 110.

At this time, opening/closing of the first to fourth ports 130, 131, 135 and 136 and the first and second dampers 132 and 133 may be controlled by a control panel 106. Of course, when a sensing signal is input through the pressure sensor 100 and the fire-detecting device 102, the control panel 106 selectively controls the first to fourth ports 130, 131, 135 and 136 and the first and second dampers 132 and 133 to be opened or closed and controls the air supplying and venting fan 104.

In this case, in the slow-train running space 120, an aperture ratio of the first port 130 for blocking the pressure wave is preferably adjusted to generate a pressure in proportion with the magnitude of the pressure wave sensed by the pressure sensor 100 in the main-line section.

With this configuration, the APS operates differently at normal times and in an event of a fire and is differently controlled according to the operating condition.

Figure 5:
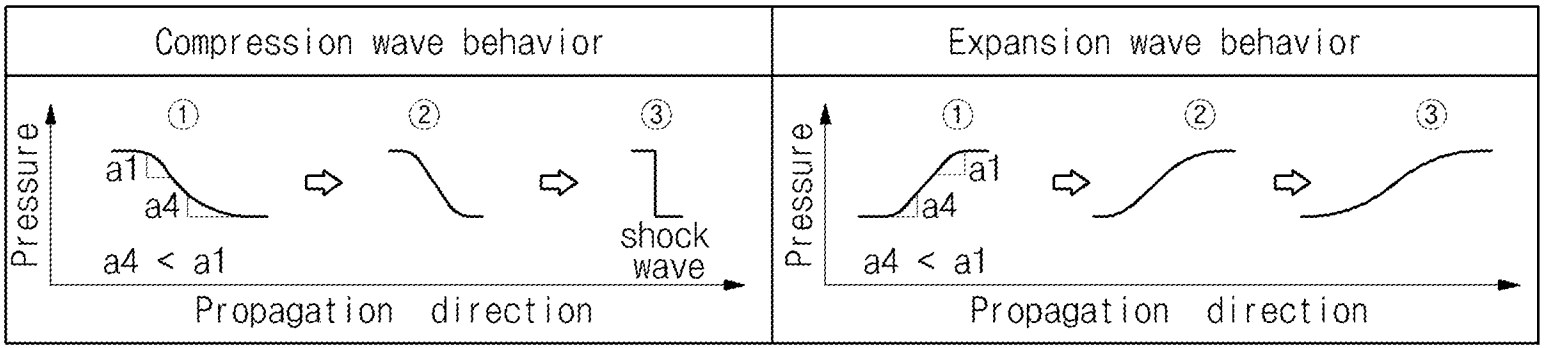
FIG. 5 is a schematic diagram for explaining behavior characteristics of compression waves and expansion waves generated when a train enters and passes through a station at a high speed.

That is to say, when the fast train 10 enters a tunnel in a high speed at normal times, as shown in FIG. 5, compression waves are generated due to a piston phenomenon caused by the front end of the fast train 10. The, gas-phase compression waves adiabatically change.

In addition, magnitudes of the compression waves generated when the train enters the tunnel are determined according to geometric structures of the tunnel and the train and the running speed of the train, and the compression waves generated when the train enters in the tunnel are propagated along the tunnel due to sonic characteristics. The compression waves are changed into expansion waves by the exit of the tunnel, a change in the geometric structure and the ventilating plant 2 in the tunnel. The compression waves and the expansion waves are repeatedly moved within the tunnel, causing an ear-discomfort to the waiting passenger.

Therefore, in order to solve the problem of ear-discomfort at normal times, first, when a propagation of the pressure wave is sensed by the pressure sensor 100, the control panel 106 controls the first and second ports 130 and 131 positioned on both ends of the second air-stream out- and in-flow space 122 arranged on the track area of the slow-train running space 120, where the slow train 20 is not waiting, to be closed, the first and second dampers 132 and 133 to be opened and the third port 135 to be opened, thereby relieving the pressure wave by venting air from the slow-train running space 120 in which the slow train 20 is not waited.

In this case, the control panel 106 controls the fourth port 136 provided on an upper portion of the fast-train running space 110, where the fast train 10 runs, to be opened, thereby relieving the pressure wave by venting the air from the fast-train running space 110.

At this time, the fourth port 136 is a pressure wave reducing port, and the pressure in the fast-train running space 110 is relieved by opening the fourth port 136.

In addition, the control panel 106 drives the air supplying and venting fan 104, opens the first and second ports 130 and 131 positioned on an upper portion of the track area of the slow-train running space 120 and closes the first and second dampers 132 and 133 to supply the air to the slow-train running space 120 in which the slow train 20 is waiting, thereby preventing the pressure wave generated when the fast train 10 runs from being propagated to the slow-train running space 120 in which the slow train 20 is waiting.

Meanwhile, in an event of a fire, a sensing signal transmitted from the fire-detecting device 102 installed in the train station is input to the control panel 106. Although the fire is spread, the origin of fire can be discriminated by a plurality of fire-detecting devices 102 installed in the train station, thereby venting smoke by opening the third or fourth port 135, 136 provided above the origin of fire.

In a case where a fire breaks out in the fast-train running space 110, the air is supplied to the slow-train running space 120 by opening the first or second port 130 or 131 positioned on an upper portion of the slow-train running space 120 and controlling driving of the air supplying and venting fan 104, thereby forming a pressurized zone and allowing passengers staying in the slow-train running space 120 to be safely evacuated.

Figure 6:
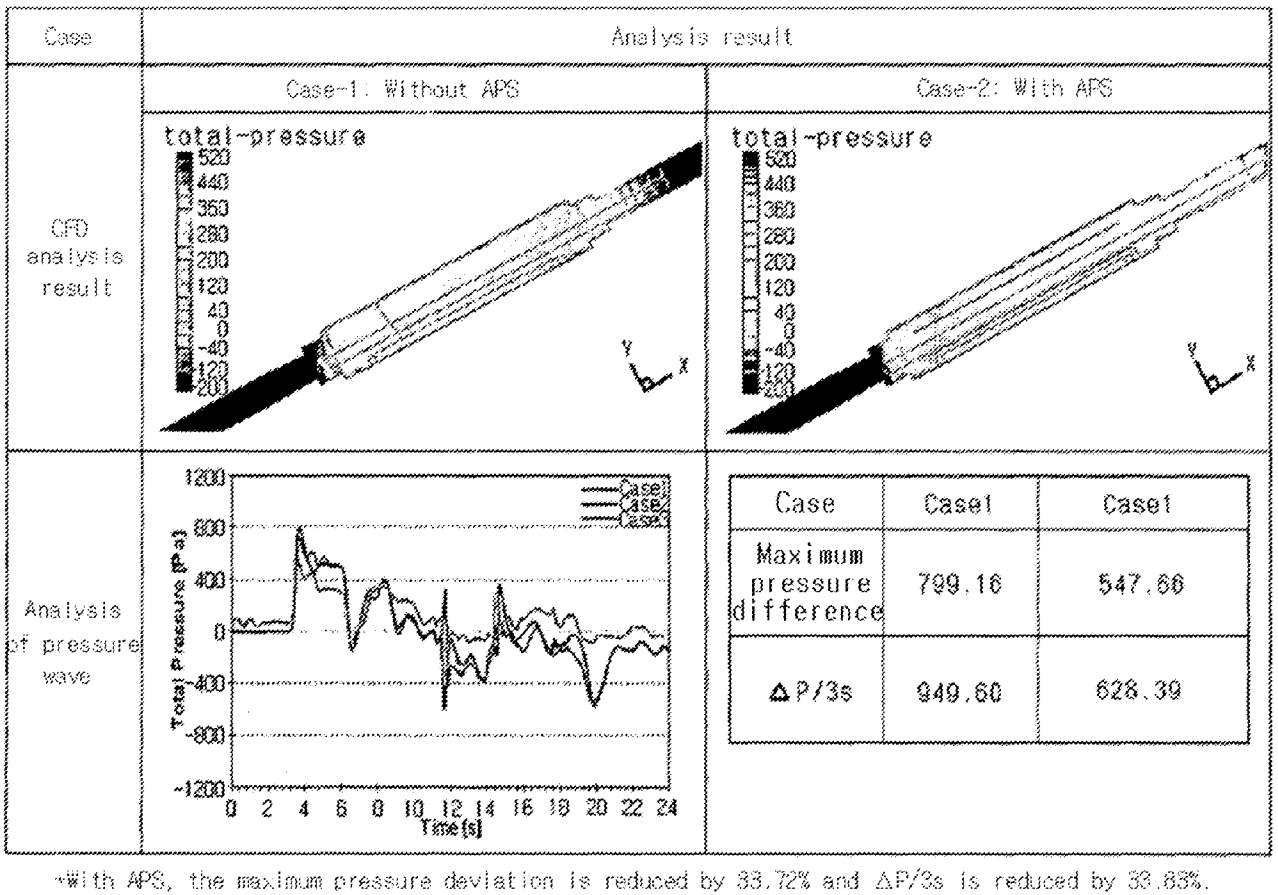
FIG. 6 is a diagram illustrating computational fluid dynamics (CFD) analysis result for ear-discomfort depending on presence or absence of the active pressurization system (APS) utilizing an upper slab of a platform track area of an underground train station according to the present invention.

The aforementioned active pressurization system (APS) is installed in the underground train station and is subjected to computational fluid dynamics (CFD) analysis to analyze ear-discomfort. The CFD analysis result is shown in FIG. 6. The CFD analysis is conducted under the following assumptions: The running speed of the fast train 10 is 250 km/h to produce a pressure wave of 1500 Pa in the main-line section. The pressure of the first and second ports 130 and 131 for supplying the air to the slow-train running space 120 is maintained at 470 Pa. The ventilating plant 2 connected to the main-line section is not employed to prevent the behavior of the pressure wave from being affected by the ventilating plant. Waiting conditions of the slow train 20 are employed. The pressure wave produced in the slow-train running space 120 is propagated to the platform due to an opened platform screen door (PSD) 108 when the slow train 20 is waiting. The APS according to the present invention can obtain satisfactory CFD analysis by employing 700 Pa as the standard for ear-discomfort of a waiting passenger, like in Hong Kong.

Figure 7:
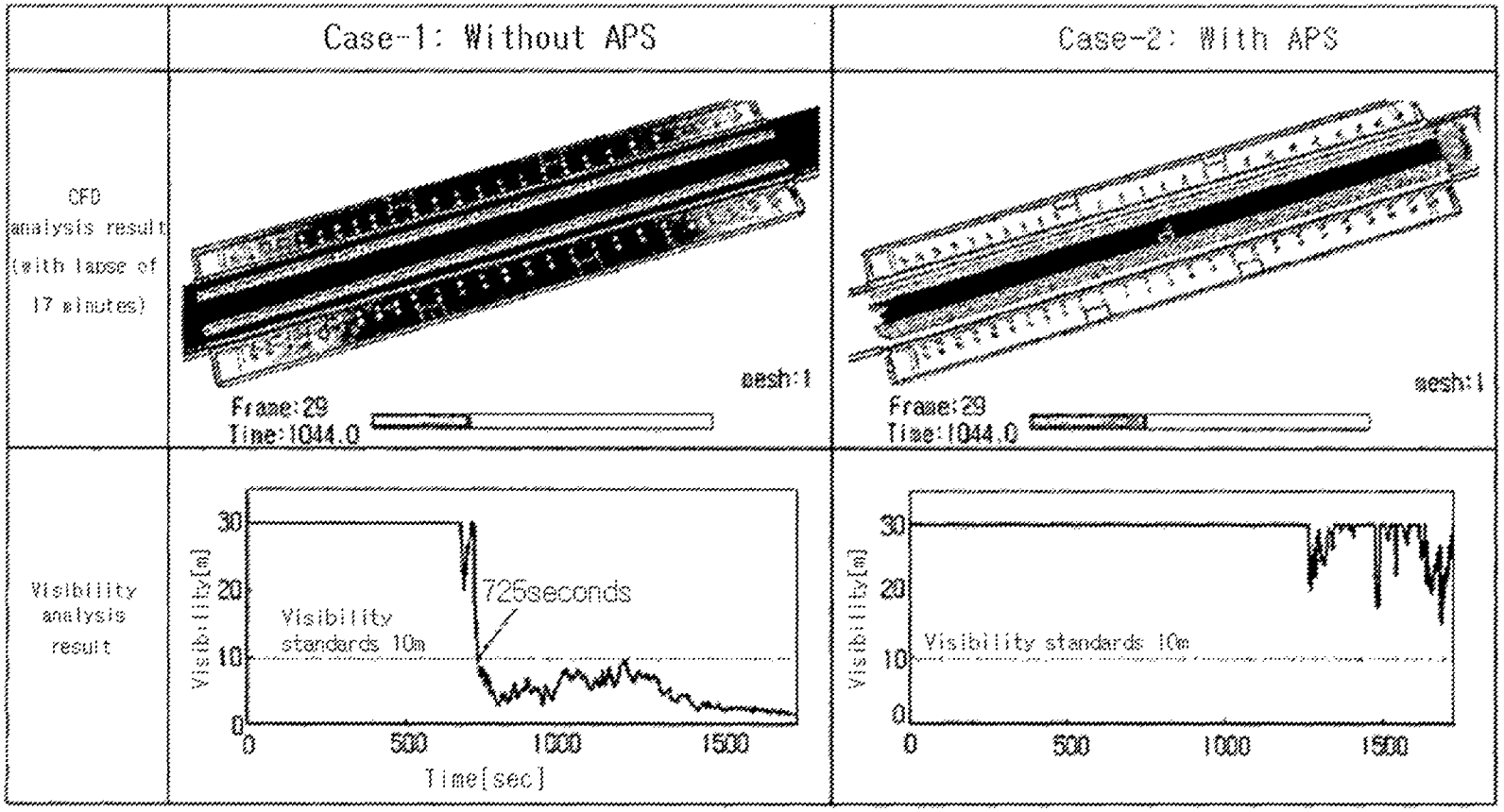
FIG. 7 is a diagram illustrating CFD analysis result for smoke-ventilating performance in an event of a fire depending on presence or absence of the active pressurization system (APS) utilizing an upper slab of a platform track area of an underground train station according to the present invention.

In an event of a fire, the smoke venting performance evaluated by CFD analysis is shown in FIG. 7. That is to say, assuming that a fire broke out in the fast train 10, the fast train stops in the underground train station, the fire volume is 15 MW and the fire broke out at the center of the train, a visibility reduction degree on a respiration safety line for evaluating the smoke venting performance was analyzed and compared with a time taken to reduce the visibility to 10 m or less, which is an evacuation limit condition. According to the CFD analysis result, in Case-1, the visibility on the respiration safety line in the main-line section of the underground train station was 10 m or less after the laps of 725 seconds. However, in Case-2, the visibility of 10 m or less was not demonstrated even after the laps of 1020 seconds. Therefore, when the APS according to the present invention is employed, refugees' safety can be increased by preventing smoke from being propagated in an event of a fire.

Although exemplary embodiments of the present invention have been described in detail hereinabove, it should be understood that many variations and modifications of the basic inventive concept herein described, which may appear to those skilled in the art, will still fall within the spirit and scope of the exemplary embodiments of the present invention as defined by the appended claims.

| Reference numerals | |
|---|---|
| 1: Underground train train station | 2: Ventilating plant |
| 3: Main-line section | 10: Fast-train |
| 20: Slow train | 100: Pressure sensor |
| 102: Fire-detecting device | 104: Air supplying and venting fan |
| 106: Control panel | 110: Fast-train running space |
| 112: First air-stream out- and in-flow space | 119: Partition wall |
| 120: Slow-train running space | 122: Second air-stream out- and in-flow space |
| 130: Firs port | 131: Seond port |
| 132: First damper | 133: Second damper |
| 135: Third port | 136: Fourth port |

The invention claimed is:

1. An active pressurization system utilizing an upper slab of a platform track area of an underground train station, characterized in that a track area of the underground train station, through which an express train and an accommodation train pass, is divided into an express-train running space and an accommodation-train running space by means of a partition wall, and a first and a second air-stream out- and in-flow space respectively linked to the express-train running space and the accommodation-train running space are formed on an upper slab of the train station, wherein the front end of the second air-stream out- and in-flow space is provided with a first port and a first damper, while the rear end is provided with a second port and a second damper, the second air-stream out- and in-flow space is provided with a third port for venting of the accommodation-train running space, and the first air-stream out- and in-flow space is provided with a fourth port for venting of the express-train running space, wherein when an express train is running, a control panel that receives sensing signals input from pressure sensors for sensing pressure ensures that, on the accommodation-train running space where there is no accommodation train waiting, the first and second ports are closed and the first and second dampers are open and the third port is open and on the express-train running space the fourth port is open, while on the accommodation-train running space where there is an accommodation train waiting, the first and second ports are open and the first and second dampers are closed and an air supplying and venting fan is driven in such a way as to supply air to the accommodation-train running space where there is an accommodation train waiting.

2. The active pressurization system of claim 1, wherein the first and second air-stream out- and in-flow spaces are provided only on the underground train station where express and accommodation trains run.

3. The active pressurization system of claim 1, wherein the air supplying and venting fan is a ventilating fan installed in an adjacent ventilating plant of the underground train station.

4. The active pressurization system of claim 1, wherein the pressure sensors are equidistantly installed from a location more than 3 km apart from the main-line section connected to the underground train station.

5. The active pressurization system of claim 4, wherein if there is an adjacent underground train station, a pressure sensor is installed in the main-line section which enters or exits from the underground train station.

6. The active pressurization system of claim 1, wherein a fire-detecting device for sensing a fire is provided in the underground train station, and if a sensing signal is input from the fire detecting device, the control panel controls the third or fourth port to be opened to vent smoke in the express-train running space and the accommodation-train running space.

7. The active pressurization system of claim 6, wherein the fire detecting device is one selected from the group consisting of a heat sensor, a gas sensor, and a thermal image camera.

8. The active pressurization system of claim 1, wherein the first and second air-steam out- and in-flow spaces are connected to a ventilating plant.

9. The active pressurization system of claim 8, the air supplying and venting fan is installed in the ventilation plant.

10. The active pressurization system of claim 9, wherein the first and second air-stream out- and in-flow spaces are provided only on the underground train station where express and accommodation trains run.

11. The active pressurization system of claim 9, wherein the pressure sensors are equidistantly installed from a location more than 3 km apart from the main-line section connected to the underground train station.

12. The active pressurization system of claim 11, wherein if there is an adjacent underground train station, a pressure sensor is installed in the main-line section which enters or exits from the underground train station.

13. The active pressurization system of claim 9, wherein a fire-detecting device for sensing a fire is provided in the underground train station, and if a sensing signal is input from the fire detecting device, the control panel controls the third or fourth port to be opened to vent smoke in the express-train running space and the accommodation-train running space.

14. The active pressurization system of claim 13, wherein the fire detecting device is one selected from the group consisting of a heat sensor, a gas sensor, and a thermal image camera.

* * * * *